United States Patent [19]

Malec

[11] 4,204,481

[45] May 27, 1980

[54] ANTI-WEAR ADDITIVES IN DIESEL FUELS

[75] Inventor: Robert E. Malec, Birmingham, Mich.

[73] Assignee: Ethyl Corporation, Richmond, Va.

[21] Appl. No.: 8,474

[22] Filed: Feb. 2, 1979

[51] Int. Cl.[2] ..... C10L 1/18; C10L 1/22

[52] U.S. Cl. ..... 123/1 A; 123/198 A; 44/53; 44/56; 44/57; 44/66; 44/71

[58] Field of Search ..... 44/53, 57, 66, 71, 56; 123/1 A, 198 A

[56] References Cited

U.S. PATENT DOCUMENTS

| | | | |
|---|---|---|---|
| 3,509,052 | 4/1970 | Murphy | 252/34.7 |
| 3,645,886 | 2/1972 | Gillespie et al. | 44/66 |
| 4,002,437 | 1/1977 | Broechx et al. | 44/66 |

FOREIGN PATENT DOCUMENTS

| | | | |
|---|---|---|---|
| 2511249 | 9/1975 | Fed. Rep. of Germany | 44/53 |
| 2701588 | 7/1978 | Fed. Rep. of Germany | 44/53 |

OTHER PUBLICATIONS

English Translation of Brazilian Patent Application No. P17700392.

*Primary Examiner*—Winston A. Douglas
*Assistant Examiner*—J. V. Howard
*Attorney, Agent, or Firm*—Donald L. Johnson; Robert A. Linn; Willard G. Montgomery

[57] ABSTRACT

An anti-wear compression ignition fuel for use in diesel engines comprising (1) a monohydroxy alkanol having from 1 to 5 carbon atoms, and (2) a wear inhibiting amount of a fatty acid amide or ester of diethanolamine. Optionally, said fuel composition may also contain an ignition accelerator such as an organic nitrate.

42 Claims, No Drawings

ANTI-WEAR ADDITIVES IN DIESEL FUELS

BACKGROUND OF THE INVENTION

It has recently been disclosed in Brazilian Patent Application No. P17700392 that alcohols, such as methanol and ethanol, can be substituted for conventional petroleum derived diesel fuels for burning in diesel engines, when used in combination with an ignition accelerator, such as ethyl nitrate or nitrite. Reportedly, the addition of alkyl nitrate or nitrite accelerators to the alcohol achieves a level of auto-ignition sufficient to operate in diesel engines. Unfortunately, these fuels compositions, devoid of any petroleum derived products, are notably deficient in lubricity or lubricating properties with the result that engine wear from the use of these fuels in internal combustion reciprocating diesel engines is a serious problem. Of particular concern are wear problems associated with the fuel injector mechanisms used in such engines. Wear problems have also been encountered in diesel engines operating on light diesel fuel oils as disclosed in U.S. Pat. No. 4,002,437.

Polyethoxylated oleamide containing an average of 5 oxyethylene units is commercially available under the name "Ethomid" (registered trademark, Armak Company). Reference to its use as a demulsifier in lubricating oil appears in U.S. Pat. No. 3,509,052.

SUMMARY OF THE INVENTION

It has now been found that the addition of a fatty acid amide or ester of diethanolamine to compression ignition fuels adapted for use in diesel engines comprising a monohydroxy alkanol having from 1 to 5 carbon atoms and optionally containing an ignition accelerator such as an organic nitrate can significantly improve the wear characteristics of said fuels.

DESCRIPTION OF THE PREFERRED EMBODIMENTS

A preferred embodiment of the present invention is an anti-wear compression ignition fuel for use in diesel engines comprising (1) a monohydroxy alkanol having from 1 to 5 carbon atoms, and (2) a wear inhibiting amount of an additive selected from the group consisting of fatty acid amides of diethanolamine, fatty acid esters of diethanolamine and mixtures thereof.

Another embodiment of the present invention is an anti-wear compression ignition fuel for use in diesel engines comprising (1) a monohydroxy alkanol having from 1 to 5 carbon atoms, (2) an ignition accelerator, and (3) a wear inhibiting amount of an additive selected from the group consisting of fatty acid amides of diethanolamine, fatty acid esters of diethanolamine and mixtures thereof.

A further embodiment of the present invention is a method for inhibiting engine wear in an internal combustion reciprocating diesel engine operating on a compression ignition fuel comprising (1) a monohydroxy alkanol having from 1 to 5 carbon atoms, (2) an ignition accelerator, and (3) a wear inhibiting amount of an additive selected from the group consisting of fatty acid amides of diethanolamine, fatty acid esters of diethanolamine and mixtures thereof, said method comprising (a) supplying to the fuel induction system of said engine said compression ignition fuel, (b) inducting air into the combustion chambers of said engine, (c) compressing said air, (d) injecting said compression ignition fuel into said combustion chambers containing said compressed air, (e) igniting said compressed mixture, and (f) exhausting the resultant combustion products resulting in reduced engine wear in said engine.

A still further embodiment of the present invention is a method for preparing a compression ignition fuel adapted for use in diesel engines having anti-wear properties which comprises blending (1) a wear inhibiting amount of an additive selected from the group consisting of fatty acid amides of diethanolamine, fatty acid esters of diethanolamine and mixtures thereof with (2) a monohydroxy alkanol having from 1 to 5 carbon atoms, and (3) an ignition accelerator.

Monohydroxy alcohols which can be used in the present invention include those containing from 1 to 5 carbon atoms. Preferred alcohols are saturated aliphatic monohydric alcohols having from 1 to 5 carbon atoms. Methanol, ethanol, propanol, n-butanol, isobutanol, amyl alcohol and isoamyl alcohol are preferred alcohols for use in the present invention. Of these, ethanol is the most preferred.

The anti-wear components of the fuel composition of the present invention are selected from the group consisting of fatty acid amides of diethanolamine, fatty acid esters of diethanolamine and mixtures thereof.

The additives can be made by forming a mixute of a fatty acid and diethanolamine and heating the mixture to remove water. Optionally, a water immiscible inert solvent such as toluene or xylene can be included to aid in the removal of water.

About 1–3 moles of fatty acid are used per mole of diethanolamine. The reaction proceeds to yield mainly amide according to the following equation $$R{-}COOH + HN{\leftarrow}C_2H_4OH{\rightarrow}_2 \longrightarrow R\overset{\overset{\displaystyle O}{\|}}{C}{-}N{-}(C_2H_4OH)_2$$

wherein R is a hydrocarbon residue of the fatty acid.

Some of the diethanolamine can react to form ester according to the following equation $$RCOOH + HN{\leftarrow}C_2H_4OH{\rightarrow}_2 \longrightarrow R\overset{\overset{\displaystyle O}{\|}}{C}{-}OC_2H_4{-}NH{-}C_2H_4OH.$$

The components can be separated by distillation and used separately in diesel fuel compositions. Preferably, they are not separated, but are used as mixtures. The mixtures can also contain fatty acid ester-amides of diethanolamine. When equal mole mixtures of fatty acid and diethanolamine are reacted very little ester-amide forms. However, when ever one mole of fatty acid is reacted with a mole of diethanolamine increased amounts of ester-amide can form according to the following equations $$2\,RCOOH + HN{\leftarrow}C_2H_4OH{\rightarrow}_2 \longrightarrow R\overset{\overset{\displaystyle O}{\|}}{C}{-}\underset{\underset{\displaystyle C_2H_4OH}{|}}{N}{-}C_2H_4O{-}\overset{\overset{\displaystyle O}{\|}}{C}{-}R$$

$$3\,RCOOH + HN{\leftarrow}C_2H_4OH{\rightarrow}_2 \longrightarrow$$

-continued

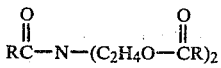

Such ester-amides are within the scope of the invention.

Preferred fatty acids used in making the wear-inhibiting additive are those containing about 8–20 carbon atoms. Examples of these are caprylic acid, pelargonic acid, capric acid, undecylic acid, lauric acid, tridecoic acid, myristic acid, stearic acid, arachidic acid and the like.

More preferably the fatty acid is an unsaturated fatty acid such as hypogeic acid, oleic acid, elaidic acid, erucic acid, brassidic acid and the like.

More preferably the fatty acid is oleic acid. Thus, the preferred additives are N,N-bis-(2-hydroxyethyl) oleamide, N-(2-hydroxyethyl)aminoethyl oleate and mixtures thereof.

EXAMPLE I

In a reaction vessel was placed 52.5 gms (0.5 mol) of diethanolamine and 141 gms (0.5 mol) of oleic acid (caution exotherm). The mixture was stirred under nitrogen and heated to 188° C. over a two-hour 13-minute period while distilling out water. The resultant product was mainly N,N-(2-hydroxyethyl)oleamide containing about 35 weight percent N-(2-hydroxyethyl)aminoethyl oleate. These components can be separated by distillation.

EXAMPLE II

In a reaction vessel was placed 282 gms of oleic acid, 105 gms diethanolamine and a small amount of xylene. The mixture was stirred under nitrogen and heated from 165°–185° C. over a two-hour period while distilling out water and returning xylene. The xylene was then stripped from the mixture under vacuum leaving 363 gms of a viscous liquid product consisting mainly of N,N-bis-(2-hydroxyethyl) oleamide and about 36 weight percent of N-(2-hydroxyethyl)aminoethyl oleate.

Other fatty acids can be substituted for oleic acid in the above examples with good results. Alternatively, the amide can be made by reacting one mole of oleamide with about two moles of ethylene oxide.

Optionally, an ignition accelerator can be added to the fuel compositions of the present invention. The ignition accelerator component of the anti-wear compression ignition fuel composition of the present invention is an organic nitrate. Preferred organic nitrates are substituted or unsubstituted alkyl or cycloalkyl nitrates having up to about 10 carbon atoms, preferably from 2 to 10 carbon atoms. The alkyl group may be either linear or branched. Specific examples of nitrate compounds suitable for use in the present invention include, but are not limited to the following:

methyl nitrate
ethyl nitrate
n-propyl nitrate
isopropyl nitrate
allyl nitrate
n-butyl nitrate
isobutyl nitrate
sec-butyl nitrate
tert-butyl nitrate
n-amyl nitrate
isoamyl nitrate
2-amyl nitrate
3-amyl nitrate
tert-amyl nitrate
n-hexyl nitrate
2-ethylhexyl nitrate
n-heptyl nitrate
sec-heptyl nitrate
n-octyl nitrate
sec-octyl nitrate
n-nonyl nitrate
n-decyl nitrate
cyclopentylnitrate
cyclohexylnitrate
methylcyclohexyl nitrate
isopropylcyclohexyl nitrate and the esters of alkoxy substituted aliphatic alcohols, such as 1-methoxypropyl-2-nitrate, 1-ethoxpropyl-2-nitrate, 1-isopropoxy-butyl nitrate, 1-ethoxybutyl nitrate and the like. Preferred alkyl nitrates are ethyl nitrate, propyl nitrate, amyl nitrates and hexyl nitrates. Other preferred alkyl nitrates are mixtures of primary amyl nitrates or primary hexyl nitrates. By primary is meant that the nitrate functional group is attached to a carbon atom which is attached to two hydrogen atoms. Examples of primary hexyl nitrates would be n-hexyl nitrate, 2 ethylhexyl nitrate, 4-methyl-n-pentyl nitrate and the like. Preparation of the nitrate esters may be accomplished by any of the commonly used methods; such as, for example, esterification of the appropriate alcohol, or reaction of a suitable alkyl halide with silver nitrate.

Other conventional ignition accelerators may also be used in the present invention, such as hydrogen peroxide, benzoyl peroxide, etc. Further certain inorganic and organic chlorides and bromides, such as, for example, aluminum chloride, ethyl chloride or bromide may find use in the present invention as primers when used in combination with the alkyl nitrate accelerators of the present invention.

The amount of fatty acid amide or ester of diethanolamine used in the compression ignition fuel compositions of the present invention should be enough to provide the desired wear protection. This concentration is conveniently expressed in terms of weight percent of fatty acid amide or ester of diethanolamine based on the total weight of the compression ignition fuel composition. A preferred range is from about 0.01 to about 2.0 weight percent. A more preferred range is from about 0.1 to about 1.0 weight percent.

The amount of alkyl nitrate or nitrate ignition accelerator used should be an amount which will achieve the level of auto-ignition sufficient to allow the operation of diesel engines on the fuel composition of the present invention. A useful range is from about 0.1 weight percent to about 10.0 weight percent based on the total compression ignition fuel composition. Preferred amounts are between 0.5 weight percent and 3.0 weight percent.

Other additive may be used in formulating the compression ignition fuel compositions of the present inventions. These compounds include demulsifying agents, corrosion inhibitors, antioxidants, dyes, and the like, provided they do not adversely effect the anti-wear effectiveness of the dimerized unsaturated fatty acid additives.

Conventional blending equipment and techniques may be used in preparing the fuel composition of the present invention. In general, a homogeneous blend of the foregoing active components is achieved by merely blending the fatty acid amide or ester of diethanolamine component of the present invention with the monohydroxy alkanol and, if desired, ignition accelerator components of the present invention in a determined proportion sufficient to reduce the wear tendencies of the fuel. This is normally carried out at ambient temperature. The following examples illustrate the preparation of some typical fuel compositions of the present invention.

EXAMPLE I

To a blending vessel is added 1000 parts of 190 proof ethanol, and 20 parts of a fatty acid amide or ester of diethanolamine. The mixture is stirred at room temperature until homogenous forming a fuel composition useful for reducing and/or inhibiting the amount of engine wear in internal combustion reciprocating diesel engines operating on said fuel composition.

EXAMPLE II

To a blending vessel is added 1000 parts of 190 proof ethanol, and 1 part of a fatty acid amide or ester of diethanolamine. The mixture is stirred at room temperature until homogenous forming a fuel composition useful for reducing and/or inhibiting the amount of engine wear in internal combustion reciprocating diesel engines operating on said fuel composition.

The amounts of each ingredient in the foregoing compositions can be varied within the limits aforediscussed to provide the optimum degree of each property.

The lubricity or wear properties of the fuel compositions were determined in the 4-Ball Wear Test. This test is conducted in a device comprising four steel balls, three of which are in contact with each other in one plane in a fixed triangular position in a reservoir containing the test sample. The fourth ball is above and in contact with the other three. In conducting the test, the upper ball is rotated while it is pressed against the other three balls while pressure is applied by weight and lever arms. The diameter of the scar on the three lower balls are measured by means of a low power microscope, and the average diameter measured in two directions on each of the three lower balls is taken as a measure of the anti-wear characteristics of the fuel. A larger scar diameter means more wear. The balls were immersed in base fuel containing the test additives. Applied load was 5 kg and rotation was at 1,800 rpm for 30 minutes at ambient temperature. Tests were conducted both with base fuel* alone and base fuel containing the test additives. Results are as follows:

| Additive[1] Conc. (wt. %) | Scar Diameter (mm) Run 1 | Run 1 |
|---|---|---|
| None | 0.89 | 0.90 |
| 1.0 | 0.45 | |

[1]N,N-bis-(2-hydroxyethyl)oleamide.
*Base fuel was 190 proof ethanol.

In two separate tests, the test fuels without any additive gave scar diameters of 0.89 and 0.90 mm, respectively. The addition to the base fuel of N,N-bis-(2-hydroxyethyl) oleamide at a concentration of 1.0 weight percent significantly, reduced the wear index to 0.45 mm. Thus, the incorporation of N,N-bis-(2-hydroxyethyl)oleamide into alcohol or alcohol containing fuels significantly increases the wear inhibiting properties of these fuels.

The wear inhibiting agents of the present invention are also effective in increasing the wear inhibiting properties of fuel compositions comprising mixtures of monohydroxy alkanols having from 1 to 5 carbon atoms and fuel oil boiling above the gasoline boiling range, i.e. a mixture of hydrocarbons boiling in the range of about 300° F. to about 700° F., such compositions may also contain ignition accelerators such as the organic nitrates referred to previously.

Further, the anti-wear agents of the present invention are also effective for increasing the wear inhibiting properties of diesel fuel compositions comprising a mixture of hydrocarbons boiling in the range of from about 300° F. to about 700° F. devoid of any alcohol components. Such fuel oil compositions comprise both the heavy and light diesel fuel oils which are commonly used at present as fuel in diesel motor vehicles. Such fuel compositions may also contain ignition accelerators such as organic nitrates as well as other additives such as demulsifying agents, corrosion inhibitors, antioxidants, dyes, and the like commonly used in these type of fuel compositions.

Thus, another embodiment of the present invention is an anti-wear compression ignition fuel for use in diesel engines comprising a fuel oil boiling above the gasoline range containing a wear-inhibiting amount of an additive selected from the group consisting of fatty acid amides of diethanolamine, fatty acid esters of diethanolamine, fatty acid ester-amides of diethanolamine and mixtures thereof.

I claim:

1. As a new composition of matter, an anti-wear compression ignition fuel for use in diesel engines comprising (1) a monohydroxy alkanol having from 1 to 5 carbon atoms, and (2) a wear inhibiting amount of an additive selected from the group consisting of fatty acid amides of diethanolamine, fatty acid esters of diethanolamine and mixtures thereof.

2. The composition of claim 1 wherein said monohydroxy alkanol is ethanol.

3. The composition of claim 2 wherein said additive is N,N-bis-(2-hydroxyethyl)oleamide.

4. The composition of claim 3 containing from about 0.01 to about 2.0 weight percent N,N-bis-(2-hydroxyethyl) oleamide based on the total weight of said composition.

5. As a new composition of matter, an anti-wear compression ignition fuel for use in diesel engines comprising (1) a monohydroxy alkanol having from 1 to 5 carbon atoms, (2) an ignition accelerator, and (3) a wear inhibiting amount of an additive selected from a group consisting of fatty acid amides of diethanolamine, fatty acid esters of diethanolamine and mixtures thereof.

6. The composition of claim 5 wherein said monohydroxy alkanol is ethanol.

7. The composition of claim 5 wherein said ignition accelerator is a substituted or unsubstituted alkyl or cycloalkyl nitrate having up to ten carbon atoms.

8. The composition of claim 5 wherein said additive is N,N-bis-(2-hydroxyethyl)oleamide.

9. The composition of claim 6 wherein said ignition accelerator is selected from methyl nitrate, ethyl nitrate, propyl nitrate, amyl nitrates, hexyl nitrates or a mixture of primary amyl nitrates and primary hexyl nitrates.

10. The composition of claim 9 wherein said ignition accelerator is ethyl nitrate.

11. The composition of claim 9 wherein said additive is N,N-bis-(2-hydroxyethyl)oleamide.

12. The composition of claim 11 containing from about 0.1 to about 10.0 weight percent ignition accelerator and from about 0.01 to about 2.0 weight percent in N,N-bis-(2-hydroxyethyl)oleamide based on the total weight of said composition.

13. A method for inhibiting engine wear in an internal combustion reciprocating diesel engine operating on a compression ignition fuel comprising (1) a monohydroxy alkanol having from 1 to 5 carbon atoms, (2) an ignition accelerator, and (3) a wear inhibiting amount of an additive selected from the group consisting of fatty acid amides of diethanolamine, fatty acid esters of diethanolamine, and mixtures thereof, said method comprising (a) supplying to the fuel induction system of said engine said compression ignition fuel,
(b) inducting air into the combustion chambers of said engine,
(c) compressing said air,
(d) injecting said compression ignition fuel into said combustion chambers containing said compressed air,
(e) igniting said compressed mixture, and
(f) exhausting the resultant combustion products resulting in reduced engine wear in said engine.

14. The method of claim 13 wherein said monohydroxy alkanol is ethanol.

15. The method of claim 13 wherein said ignition accelerator is a substituted or unsubstituted alkyl or cycloalkyl nitrate having up to ten carbon atoms.

16. The method of claim 13 wherein said additive is N,N-bis-(2-hydroxyethyl)oleamide.

17. The method of claim 14 wherein said ignition accelerator is selected from methyl nitrate, ethyl nitrate, propyl nitrate, amyl nitrates, hexyl nitrates or a mixture of primary amyl nitrates and primary hexyl nitrates.

18. The method of claim 17 wherein said ignition accelerator is ethyl nitrate.

19. The method of claim 17 wherein said additive is N,N-bis-(2-hydroxyethyl)oleamide.

20. The method of claim 19 wherein said ignition accelerator is present in an amount of from about 0.1 weight percent to about 10.0 weight percent based on the total weight of said composition and said N,N-bis-(2-hydroxyethyl)oleamide is present in an amount of from about 0.01 to about 2.0 weight percent based on the total weight of the composition.

21. A method for preparing a compression ignition fuel adapted for use in diesel engines having anti-wear properties which comprises blending (1) a wear inhibiting amount of an additive selected from the group consisting of fatty acid amides of diethanolamine, fatty acid esters of diethanolamine, and mixtures thereof, (2) a monohydroxy alkanol having from 1 to 5 carbon atoms, and (3) an ignition accelerator.

22. The method of claim 21 wherein said monohydroxy alkanol is ethanol.

23. The method of claim 21 wherein said ignition accelerator is a substituted or unsubstituted alkyl or cycloalkyl nitrate having up to ten carbon atoms.

24. The method of claim 21 wherein said additive is N,N-bis-(2-hydroxyethyl)oleamide.

25. The method of claim 22 wherein said ignition accelerator is selected from methyl nitrate, ethyl nitrate, propyl nitrate, amyl nitrates, hexyl nitrates or a mixture of primary amyl nitrates and primary hexyl nitrates.

26. The method of claim 25 wherein said ignition accelerator is ethyl nitrate.

27. The method of claim 25 wherein said additive is N,N-bis(2-hydroxyethyl)oleamide.

28. The method of claim 27 wherein said ignition accelerator is present in an amount of from about 0.1 to about 10.0 weight percent based on the total weight of said composition and said N,N-bis-(2-hydroxyethyl-)oleamide is present in an amount of from about 0.01 to about 2.0 weight percent.

29. An anti-wear compression ignition fuel for use in diesel engines comprising a fuel oil boiling above the gasoline range containing a wear inhibiting amount of an additive selected from the group consisting of fatty acid amides of diethanolamine, fatty acid esters of diethanolamine, fatty acid ester-amides of diethanolamine and mixtures thereof.

30. The compression ignition fuel of claim 29 wherein said additive is N,N-bis-(2-hydroxyethyl)oleamide.

31. The compression ignition fuel of claim 29 containing as an ignition accelerator a substituted or unsubstituted alkyl or cycloalkyl nitrate having up to ten carbon atoms.

32. The compression ignition fuel of claim 30 containing an ignition accelerator selected from methyl nitrate, ethyl nitrate, propyl nitrate, amyl nitrates, hexyl nitrates or a mixture of primary amyl nitrates and primary hexyl nitrates.

33. As a new composition of matter, an anti-wear compression ignition fuel for use in diesel engines comprising (1) a monohydroxy alkanol having from 1 to 5 carbon atoms, and (2) a wear inhibiting amount of N,N-bis-(2-hydroxyethyl)oleamide.

34. As a new composition of matter an anti-wear compression ignition fuel for use in diesel engines comprising (1) a monohydroxy alkanol having from 1 to 5 carbon atoms, and (2) from about 0.01 to about 2.0 weight percent N,N-bis-(2-hydroxyethyl)oleamide based on the total weight of said composition.

35. As a new composition of matter, an anti-wear compression ignition fuel for use in diesel engines comprising (1) a monohydroxy alkanol having from 1 to 5 carbon atoms, (2) a substituted or unsubstituted alkyl or cycloalkyl nitrate having up to 10 carbon atoms, and (3) a wear inhibiting amount of N,N-bis-(2-hydroxyethyl-)oleamide.

36. As a new composition of matter, an anti-wear compression ignition fuel for use in diesel engines comprising (1) a monohydroxy alkanol having from 1 to 5 carbon atoms, (2) an ignition accelerator selected from methyl nitrate, ethyl nitrate, propyl nitrate, amyl nitrates, hexyl nitrates or a mixture of primary amyl nitrates and primary hexyl nitrates, and (3) a wear inhibiting amount of N,N-bis-(2-hydroxyethyl)oleamide.

37. As a new composition of matter, an anti-wear compression ignition fuel for use in diesel engines comprising (1) a monohydroxy alkanol having from 1 to 5 carbon atoms, (2) ethyl nitrate, and (3) a wear inhibiting amount of N,N-bis-(2-hydroxyethyl)oleamide.

38. As a new composition of matter, an anti-wear compression ignition fuel for use in diesel engines comprising (1) ethanol, (2) ethyl nitrate, and a wear inhibiting amount of N,N-bis-(2-hydroxyethyl)oleamide.

39. A method for preparing a compression ignition fuel adapted for use in diesel engines having anti-wear properties which comprises blending (1) a wear inhibiting amount of N,N-bis-(2-hydroxyethyl)oleamide, (2) a monohydroxy alkanol having from 1 to 5 carbon atoms, and (3) a substituted or unsubstituted alkyl or cycloalkyl nitrate having up to 10 carbon atoms.

40. A method for preparing a compression ignition fuel adapted for use in diesel engines having anti-wear properties which comprises blending (1) a wear inhibiting amount of N,N-bis-(2-hydroxyethyl)oleamide, (2) a monohydroxy alkanol having from 1 to 5 carbon atoms, and (3) an ignition accelerator selected from methyl nitrate, ethyl nitrate, propyl nitrate, amyl nitrates, hexyl nitrates or a mixture of primary amyl nitrates and primary hexyl nitrates.

41. A method for preparing a compression ignition fuel adapted for use in diesel engines having anti-wear properties which comprises blending (1) a wear inhibiting amount of N,N-bis-(2-hydroxyethyl)oleamide, (2) ethanol and (3) ethyl nitrate.

42. A method for preparing a compression ignition fuel adapted for use in diesel engines having anti-wear properties which comprises blending (1) from about 0.01 to about 2.0 weight percent N,N-bis-(2/hydroxyethyl)oleamide, (2) ethanol, and (3) from about 0.1 to about 10.0 weight percent ethyl nitrate based on the total weight of said composition.

* * * * *